US012523429B2

(12) United States Patent
Al-Otaibi et al.

(10) Patent No.: US 12,523,429 B2
(45) Date of Patent: Jan. 13, 2026

(54) SHELL-SIDE HEAT TRANSFER ENHANCEMENT

(71) Applicant: Saudi Arabian Oil Company, Dhahran (SA)

(72) Inventors: Abdullah Misfer Al-Otaibi, Khobar (SA); John O'Connell, Dhahran (SA); Papa Cisse, Dhahran (SA); Mohammad Ahmad Elyyan, Dhahran (SA); Mohammed Rashed Aldossary, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 167 days.

(21) Appl. No.: 18/500,316

(22) Filed: Nov. 2, 2023

(65) Prior Publication Data

US 2025/0146759 A1 May 8, 2025

(51) Int. Cl.
*F28D 7/00* (2006.01)
*F28D 7/10* (2006.01)

(52) U.S. Cl.
CPC ..... *F28D 7/10* (2013.01)

(58) Field of Classification Search
CPC ..... F28D 7/10; F28F 9/0131
USPC ..... 165/159
See application file for complete search history.

(56) References Cited

U.S. PATENT DOCUMENTS 3,895,674 A 7/1975 Harris
3,938,588 A 2/1976 Coit et al.
4,114,684 A * 9/1978 Jenis ..... F28F 9/0131 165/DIG. 54
4,576,222 A 3/1986 Granata, Jr. et al.
6,868,695 B1 3/2005 Dingel et al.
10,386,120 B2 8/2019 Rizzi
11,034,895 B1 * 6/2021 Oza ..... C10G 45/60
(Continued)

FOREIGN PATENT DOCUMENTS

FR 984248 A 7/1951

OTHER PUBLICATIONS

International Search Report and Written Opinion for International Application No. PCT/US2024/053183; report mail date Jan. 30, 2025.

*Primary Examiner* — Davis D Hwu
(74) *Attorney, Agent, or Firm* — Bracewell LLP; Constance G. Rhebergen; Eleanor T. Porter

(57) ABSTRACT

A device for distributing flow through a shell side of a shell-and-tube heat exchanger, the device comprising a shell-side flow distributor configured to direct flow through all zones of a tube-bundle positioned in the shell, the shell-side flow distributor comprising an inlet flow distributor configured to direct flow from an inlet nozzle to all zones of the tube-bundle, the inlet flow distributor comprising an inlet distributor plate positioned proximate to the inlet nozzle in the shell side; and one or more window distributor plates, each window distributor plate comprising a window extending through a thickness of the window distributor plate, wherein the one or more window distributor plates are arranged in a vertical stack adjacent to the inlet distributor plate; and a flow guidance system, the flow guidance system disposed in the tube-bundle, wherein the flow guidance system comprises one or more flow guidance plates.

9 Claims, 5 Drawing Sheets

(56) References Cited

U.S. PATENT DOCUMENTS

| | | | |
|---|---|---|---|
| 2009/0242178 | A1 | 10/2009 | Al-Anizi et al. |
| 2011/0226455 | A1 | 9/2011 | Al-Anizi et al. |

* cited by examiner

SHELL-SIDE HEAT TRANSFER ENHANCEMENT

TECHNICAL FIELD

Disclosed are systems and methods for enhancement of heat transfer in the shell-side of a heat exchanger. Specifically, disclosed are systems and methods for enhancement of heat transfer in the shell-side of a heat exchanger by modifying tube-bundle geometry.

BACKGROUND

Heat exchangers are a work horse in industrial processing. Many heat exchanger types are available for different operating conditions. However, heat exchangers with cross flow shell-side may result in flow maldistribution, liquid entrainment carry-over, low performance, and other issues. These issues can be pronounced when the inlet and outlet nozzles are facing each other. As shown in FIG. 1, a TEMA type X heat exchanger is provided where the inlet nozzle A is directly across from the outlet nozzle B. Tube-bundle Cis dived by vertical support baffles D which creates zones D-1, D-2, D-3, and D-4. The fluid enters inlet nozzle A and passes directly to the outlet nozzle primarily through zones D-2 and D-3 such that zones D-1 and D-4 are dead zones. Additionally, because the flow passes directly there is limited turbulent flow. This causes uneven and inefficient heat transfer across the tube bundle.

SUMMARY

Disclosed are systems and methods for enhancement of heat transfer in the shell-side of a heat exchanger. Specifically, disclosed are systems and methods for enhancement of heat transfer in the shell-side of a heat exchanger by modifying tube-bundle geometry.

In a first aspect, a device for distributing flow through a shell side of a shell-and-tube heat exchanger is provided. The device includes a shell-side flow distributor, the shell-side flow distributor configured to direct flow through all zones of a tube-bundle positioned in the shell. The shell-side flow distributor includes an inlet flow distributor, the inlet flow distributor configured to direct flow from an inlet nozzle to all zones of the tube-bundle. The inlet flow distributor includes an inlet distributor plate positioned proximate to the inlet nozzle in the shell side, and one or more window distributor plates, each window distributor plate includes a window extending through a thickness of the window distributor plate, where the one or more window distributor plates are arranged in a vertical stack adjacent to the inlet distributor plate. The shell-side flow distributor also includes a flow guidance system, the flow guidance system disposed in the tube-bundle, where the flow guidance system includes one or more flow guidance plates.

In certain aspects, the shell-and-tube heat exchanger includes a shell configuration selected from the group consisting of TEMA type G, TEMA type H, TEMA type J, and TEMA type X. In certain aspects, the inlet distributor plate is selected from the group consisting of a rectangular plate and an oval plate. In certain aspects, each window distributor plate is a different size, where the vertical stack of window distributor plates is arranged in increasing size such that the smallest window distributor plate is adjacent to the inlet distributor plate and the largest window distributor is nearest the tube-bundle. In certain aspects, the size of each window in each window distributor plate is between 25% and 95% of the area of the window distributor plate and the size of the window distributor plate adjacent to the inlet distributor plate is between 25% and 95% of the area of the inlet distributor plate. In certain aspects, the device further includes impingement adsorbers, the impingement adsorbers connecting the inlet distributor plate and the first window distributor plate. In certain aspects, the one or more flow guidance plates comprise at least one opening in each zone of the tube-bundle, where each opening extends through a thickness of the flow guidance plate. In certain aspects, the device the flow guidance system includes at least two flow guidance plates layered in the tube-bundle with space between each flow guidance plate and arranged such that the openings in one flow guidance plate are offset from the other flow guidance plate. In certain aspects, the inlet flow distributor is positioned in the shell side between the inlet nozzle and the tube-bundle. In certain aspects, each flow guidance plate is rectangular.

In a second aspect, a method for distributing flow through a shell side of a shell-and-tube heat exchanger is provided. The method includes the steps of introducing a fluid through an inlet nozzle on the shell side of the shell-and-tube heat exchanger, introducing the fluid to an inlet flow distributor, where the inlet flow distributor is configured to disperse the fluid to each zone of a tube-bundle positioned in the shell side of the shell-and-tube heat exchanger, where each zone is defined by vertical support baffles arrayed perpendicular to the tube-bundle, dispersing the fluid through the inlet flow distributor such that the fluid reaches each zone of the tube-bundle, and dispersing the fluid through a flow guidance system positioned in the tube-bundle parallel to the tubes such that the velocity of the fluid through each zone is equivalent.

In certain aspects, the step of dispersing the fluid through the inlet flow distributor includes the steps of striking an inlet distributor plate of the inlet flow distributor with the fluid, the inlet distributor plate positioned proximate to the inlet nozzle, dispersing the fluid around the inlet distributor plate such that a portion of the fluid hits a first window distributor plate positioned parallel to the inlet distributor plate, where the first window distributor plate includes a window extending through a thickness of the first window distributor plate with an area less than the area of the inlet distributor plate, dispersing the fluid both around the edges of the first window distributor plate and through the window of the first distributor plate such that at least a port of the fluid hits a second window distributor plate positioned parallel to the first window distributor plate, where the second window distributor plate includes a window extending through a thickness of the second window distributor plate with an area greater than the area of the window in the first window distributor plate, and dispersing the fluid both around the edges of the second window distributor plate and through the window of the second window distributor plate. In certain aspects, the method further includes the step of striking a third window distributor plate positioned parallel to the second window distributor plate with fluid dispersed around the edges of the second window distributor plate, where the third window distributor plate includes a window extending through a thickness of the third window distributor plate, where the window in the third window distributor plate has an area greater than the area of the window in the second window distributor plate. In certain aspects, the step of dispersing the fluid through the flow guidance system includes the steps of dispersing the fluid through openings in a first flow guidance plate positioned in the tube-bundle and parallel to the tubes, where at least one opening is positioned in each zone of the tube-bundle, where the first flow guidance plate is proximate to the inlet flow distributor, and dispersing the fluid through openings in a second flow guidance plate positioned in the tube-bundle parallel to the first flow guidance plate, where at least one opening is positioned in each zone of the tube-bundle offset from the openings in the first flow guidance plate. In certain aspects, the method further includes the step of dispersing the fluid through openings in a third flow guidance plate positioned in the tube-bundle parallel to the second flow guidance plate, where at least one opening is positioned in each zone of the tube-bundle offset from the openings in the second flow guidance plate. In certain aspects, the second flow guidance plate extends through the vertical support baffles positioned on either end of the tube-bundles. In certain aspects, the first window distributor plate is larger than the inlet distributor plate. In certain aspects, the first window distributor plate and the second window distributor plate are rectangular.

In a third aspect, a device for distributing flow through a shell side of a shell-and-tube heat exchanger is provided. The device includes a shell-side flow distributor, the shell-side flow distributor configured to direct flow through all zones of a tube-bundle positioned in the shell, the shell-side flow distributor includes an inlet flow distributor, the inlet flow distributor configured to direct flow from an inlet nozzle to all zones of the tube-bundle, the inlet flow distributor includes an inlet distributor plate positioned proximate to the inlet nozzle in the shell side, a first window distributor plate adjacent to the inlet distributor plate, the first window distributor plate includes a window extending through a thickness of the first window distributor plate, and a second window distributor plate adjacent to the second window distributor plate, the second window distributor plate includes a window extending through a thickness of the second window distributor plate, and a flow guidance system, the flow guidance system includes flow guidance plates.

BRIEF DESCRIPTION OF THE DRAWINGS

These and other features, aspects, and advantages of the scope will become better understood with regard to the following descriptions, claims, and accompanying drawings. It is to be noted, however, that the drawings illustrate only several embodiments and are therefore not to be considered limiting of the scope as it can admit to other equally effective embodiments.

In the accompanying Figures, similar components or features, or both, may have a similar reference label.

DETAILED DESCRIPTION

While the scope of the apparatus and method will be described with several embodiments, it is understood that one of ordinary skill in the relevant art will appreciate that many examples, variations and alterations to the apparatus and methods described here are within the scope and spirit of the embodiments.

Accordingly, the embodiments described are set forth without any loss of generality, and without imposing limitations, on the embodiments. Those of skill in the art understand that the scope includes all possible combinations and uses of particular features described in the specification.

The systems and methods provide a shell-side flow distributor that can be positioned inside the shell-side of a heat exchanger to enhance flow distribution in the shell side by reducing or removing liquid entrainments and enhancing the heat transfer coefficient by having more flow turbulence. The shell-side flow distributor includes an inlet flow distributor and flow guidance system. Advantageously, the shell-side flow distributor can optimize heat exchanger size by improving flow distribution, avoiding integrity issues, and enhancing the overall heat transfer coefficient. Advantageously, the use of shell-side flow distributor improves performance by 30% to 50% compared to a heat exchanger in the absence of a shell-side flow distributor. Performance can be measured by evaluating the change in temperature of the heat transfer fluid and the process fluid. Increased heat transfer between the fluids is a result of velocity enhancement over all zones in shell-side, more turbulent flow, and a good utilization of the total surface area of the heat exchanger]

As used throughout, "size" refers to the appropriate dimension for the part. Size of a nozzle or other piping refers to diameter. Size of a distributor plate includes length, width and thickness.

As used throughout, "fluid" refers to the gas or liquid flowing in and through the shell-side of the heat exchanger. Fluids can include air, gases, water, hydrocarbon, and any other fluid suitable for use in a heat exchanger.

Figure 1:
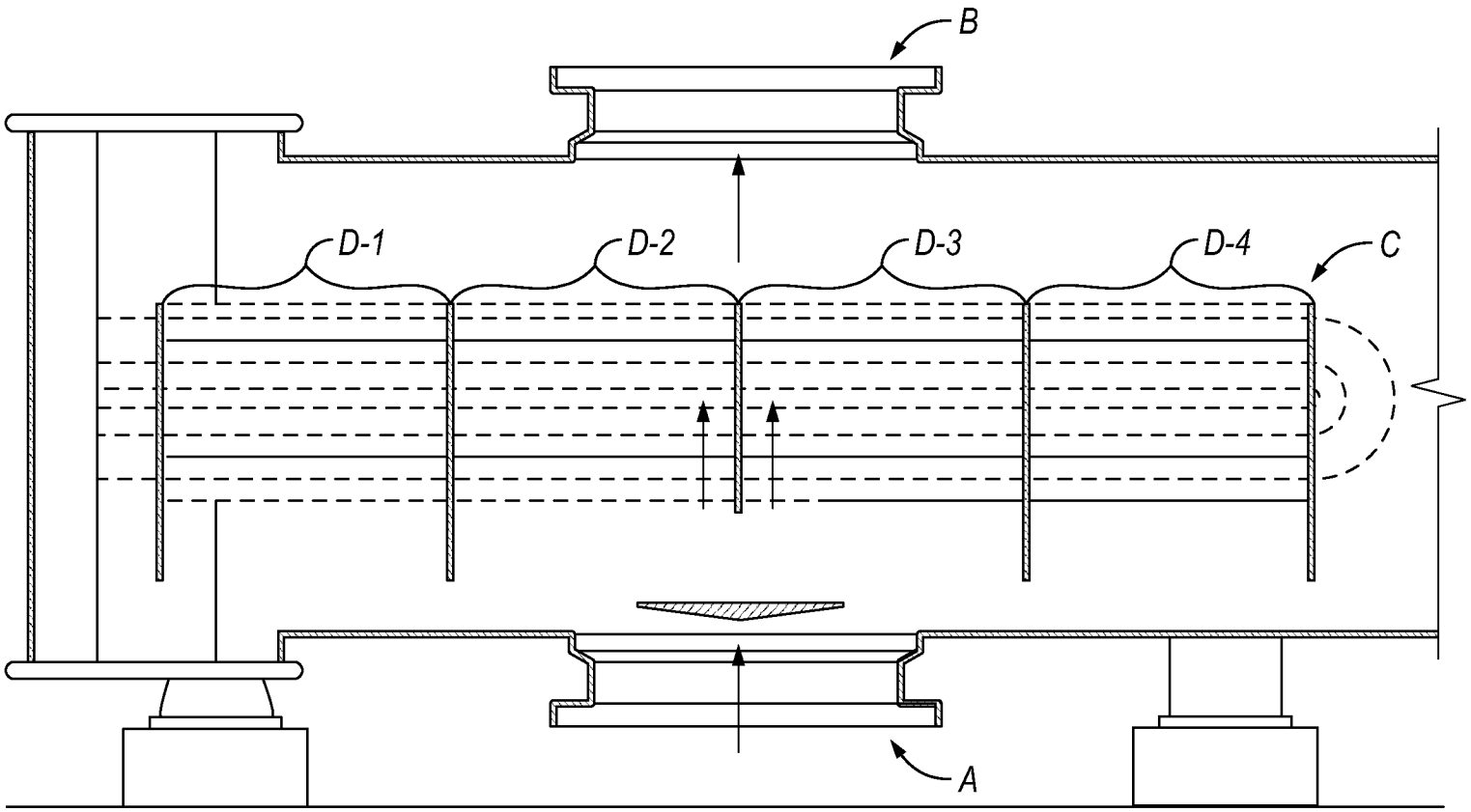
FIG. 1 (Prior Art)
FIG. 1 is a side plan view of a shell and tube heat exchanger of the prior art.
Figure 2:
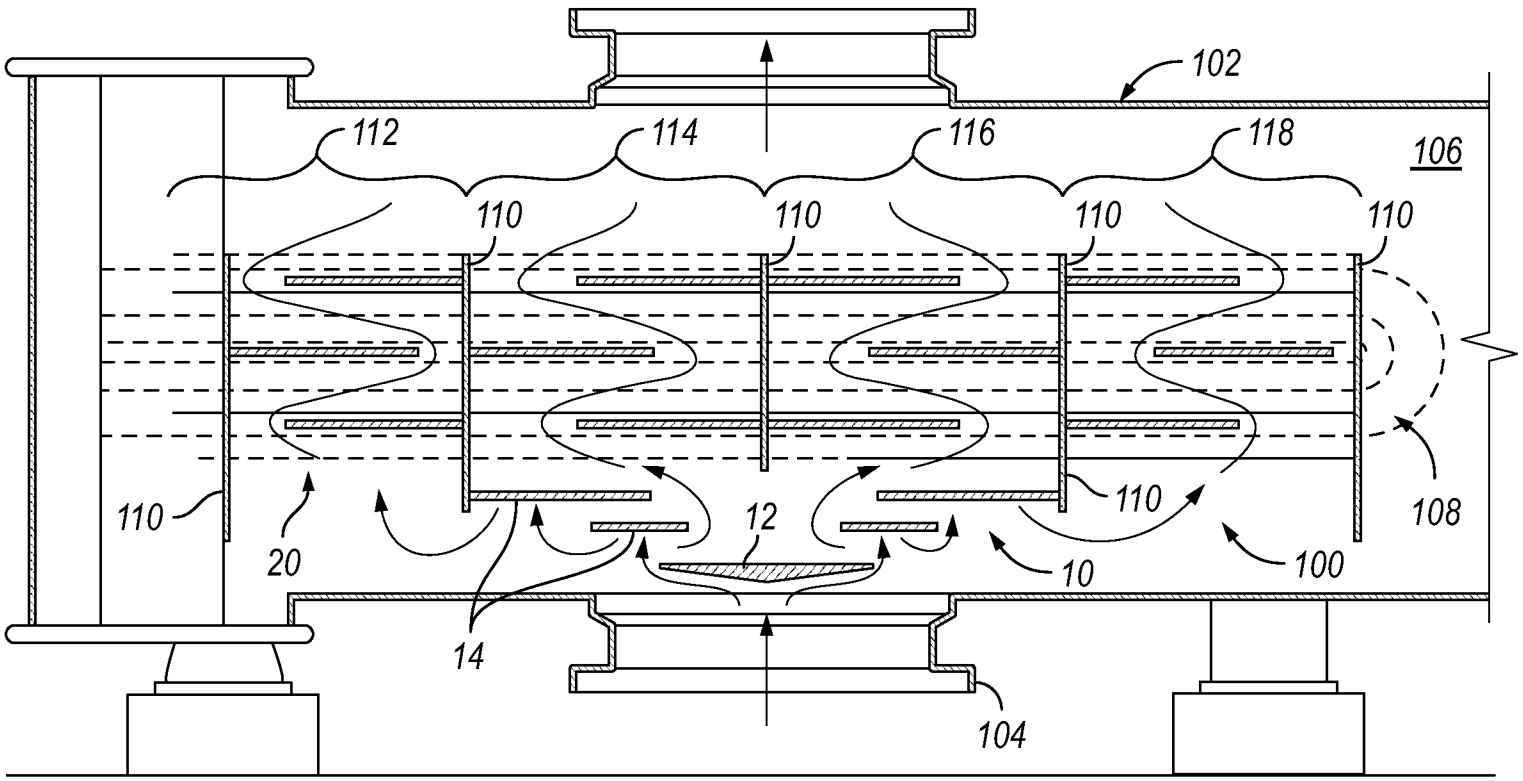
FIG. 2 is a side plan view of a shell-side flow distributor including an inlet flow distributor and a flow guidance system positioned in a heat exchanger.

Referring to FIG. 2, an embodiment of the shell-side flow distributor can be described. Shell-side flow distributor 100 can include inlet flow distributor 10 and flow guidance system 20. Shell-side flow distributor 100 can be positioned on shell-side 106 of shell-and-tube heat exchanger 102. The shell-and-tube heat exchanger can have any type of shell configuration or shell type having nozzles suitable for cross-flow. Examples of shell configurations or shell types in which shell-side flow distributor 100 is suitable for use include TEMA types G, H, J and X. Shell-side flow distributor 100 is suitable for use in horizontally arranged exchangers. In embodiments including inlet flow distributor 10, the inlet nozzle can be positioned at any point in the shell of the heat exchanger. In embodiments using only flow guidance system 20, the inlet nozzle is located in the middle of the heat exchanger.

Figure 4A:
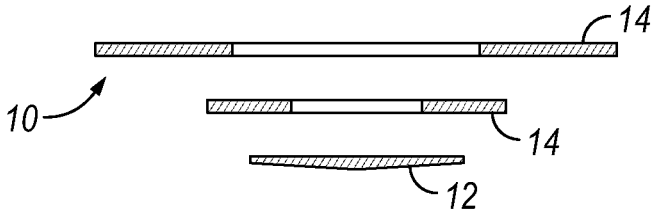
FIG. 4A is side view in elevation of an inlet flow distributor.
Figure 4B:
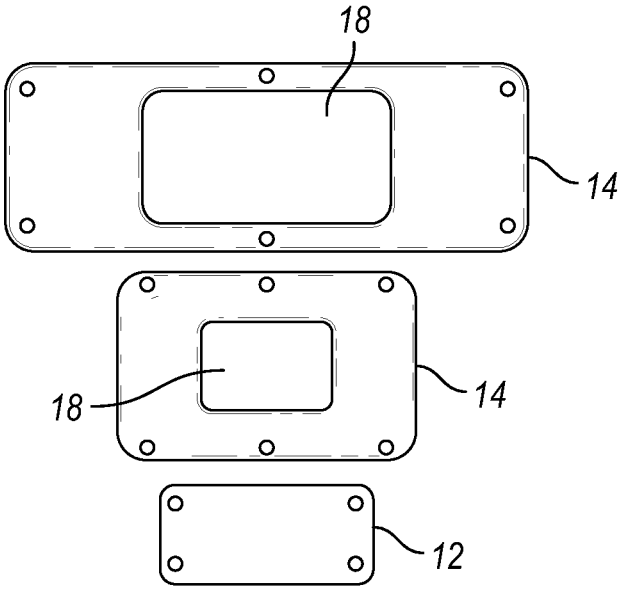
FIG. 4B is a top view of an inlet flow distributor.

Inlet flow distributor 10 is positioned proximate to inlet nozzle 104 of shell-and-tube heat exchanger 102. One of skill in the art can appreciate that inlet flow distributor 10 can be positioned in inlet nozzle 104 regardless of the orientation of inlet nozzle 104 relative to grade. Inlet flow distributor 10 can be designed to distribute the fluid flowing through the inlet nozzle over the tube-bundle 108. Inlet flow distributor 10 can be understood with reference to FIGS. 4A and 4B. Inlet flow distributor 10 includes one inlet distributor plate 12 and one or more window distributor plates 14. Together the inlet distributor plate and the one or more window distributor plates are referred to as distributor plates.

Inlet distributor plate 12 can be a continuous curved plate such that the side of the plate facing the inlet nozzle is concave. Advantageously, the concave surface of the inlet distributor plate with the concave surface facing the inlet nozzle the force of the fluid hitting the inlet distributor plate is reduced. Advantageously, the concave surface of the inlet distributor plate reduces impingement flow and evenly distributes the fluid entering the shell. The concave shape of the plate can be achieved by reinforcing the plate with multiple layers of different sizes to give the plate more stability. Inlet distributor plate 12 can be a rectangular plate or an oval plate. In embodiments where inlet distributor plate 12 is a rectangular plate, the corners of inlet distributor plate 12 can be square or rounded. In at least one embodiment, inlet distributor plate 12 is a rectangular plate and the corners are rounded. The material of construction of inlet distributor plate 12 can depend on the fluid flowing into the shell side of the heat exchanger, where one of skill in the art would select a material that would not degrade. The size of the inlet distributor plate can depend on the size of the inlet nozzle, the space between the inlet nozzle and the tube-bundle, the flow rate through the inlet nozzle, the space between inlet distributor plate and the adjacent window distributor plate, the total number of distributor plates, and combinations of the same. Advantageously, inlet distributor plate 12 can push processes gases to the sides of the shell and away from the tube-bundle allowing more of the heat transfer fluid to reach the tube-bundle.

Inlet flow distributor 10 can include one, two, three, or more window distributor plates 14. The number of window distributor plates can depend on the size of the inlet nozzle, the space between the inlet nozzle and the tube-bundle, the flow rate through the inlet nozzle, the space between inlet distributor plate and the adjacent window distributor plate, the total number of distributor plates, and combinations of the same. In at least one embodiment, inlet flow distributor 10 includes one inlet distributor plate 12 and two window distributor plates 14.

Each window distributor plate 14 can be a rectangular plate containing a hole extending through the depth of the plate with a length and a width such that the hole defines a window in the window distributor plate. Each window distributor plate can be curved such that the side closest to the inlet nozzle is convex. Each window distributor plate can have rounded corners or square corners. In at least one embodiment, each window distributor plate has rounded corners. Every window distributor plate in an inlet flow distributor is greater in size than the inlet distributor plate. Every window distributor plate in an inlet flow distributor has a different size. Every window distributor plate 14 contains window 18. There is only one window in each window distributor plate. Each window distributor plate is in the absence of multiple perforations. Advantageously and unexpectedly, having one window for fluid to flow through better directs the flow across tube-bundle, creates more uniform flow distribution, covers more surface area of the tube bundle, and creates more turbulent flow with reduced pressure compared to a plate that has multiple perforations. Advantageously and unexpectedly, the window distributor plates reduce damage tubes and reduce vibration compared to a perforated plate. Advantageously, the use of windows in the inlet flow distributor minimizes pressure drop.

The size of window depends on the size of the inlet distributor plate, and the size of the window distributor plate. The window in the window distributor plate adjacent to the inlet distributor plate can be less than the area of the inlet distributor plate, alternately between 25% and 95% of the area of the inlet distributor plate, alternately between 25% and 75% of the area of the inlet distributor plate, alternately between 25% and 50% of the area of the inlet distributor plate, alternately between 35% and 85% of the area of the inlet distributor plate, alternately between 50% and 75% of the area of the inlet distributor plate, alternately between 50% and 95% of the area of the inlet distributor plate, alternately between 75% and 95% of the area of the inlet distributor plate. The window can be at least 25% of the area of the window distributor plate, alternately at least 50% of the area of the window distributor plate, alternately at least 75% of the area of the window distributor plate, alternately at least 95% of the area of the window distributor plate, and alternately between 25% and 95% of the area of the window distributor plate. In at least one embodiment, the size of the window is between 25% and 95% of the area of the window distributor plate.

Returning to FIG. 2, the arrangement of inlet flow distributor 10 can be understood. Regardless of the orientation of inlet flow distributor 10 on the shell-and-tube heat exchanger, inlet flow distributor 10 is arranged so that the inlet distributor plate 12 is positioned proximate to inlet nozzle 104 and the window distributor plates 14 are arranged in increasing size with the smallest closest to the inlet distributor 12 and the largest closest to tube-bundle 108. The window in window distributor plate 14 adjacent to inlet distributor plate 12 can have an area less than the area of 12 inlet distributor plate 12. The window in each additional window distributor plate 14 can have an area greater than the window in the previous window distributor plate but less than the total area of the previous window distributor plate. In this way, each distributor plate is sized such that the windows overlap the solid portions of the adjacent distributor plate. An example is provided for purposes of illustration in which the inlet flow distributor has one inlet distributor plate and three window distributor plate. If the inlet distributor plate has a size of 70 $in^2$, the first window distributor plate adjacent to the inlet distributor plate can have an overall size of 90 $in^2$ and a window with an area of 50 $in^2$, the second window distributor plate adjacent to the first window distributor plate can have an overall size of 110 $in^2$ and 60 $in^2$, and the third window distributor plate adjacent to the second window distributor plate and closest to the tube-bundle can have an overall size of 130 $in^2$ and 65 $in^2$.

The spacing between the distributor plates can be determined based on the flow rate of the fluid through inlet nozzle 104.

Figure 5:
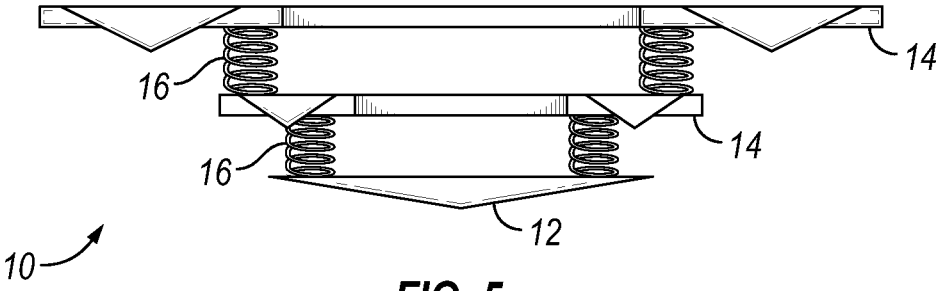
FIG. 5 is a side view of an inlet flow distributor including impingement absorbers.

The distributor plates can be supported internally and fixed to the tube-bundle. As described with reference to FIG. 5, impingement absorbers 16 can be positioned between and connecting the distributor plates. The impingement absorbers can be any type of device capable of enabling the plates to absorb shocks and inlet velocities of the fluids. Examples of impingement absorbers include springs, shock absorbers, flexible sheets that don't inhibit flow. In at least one embodiment, the impingement absorbers are springs.

Figure 3:
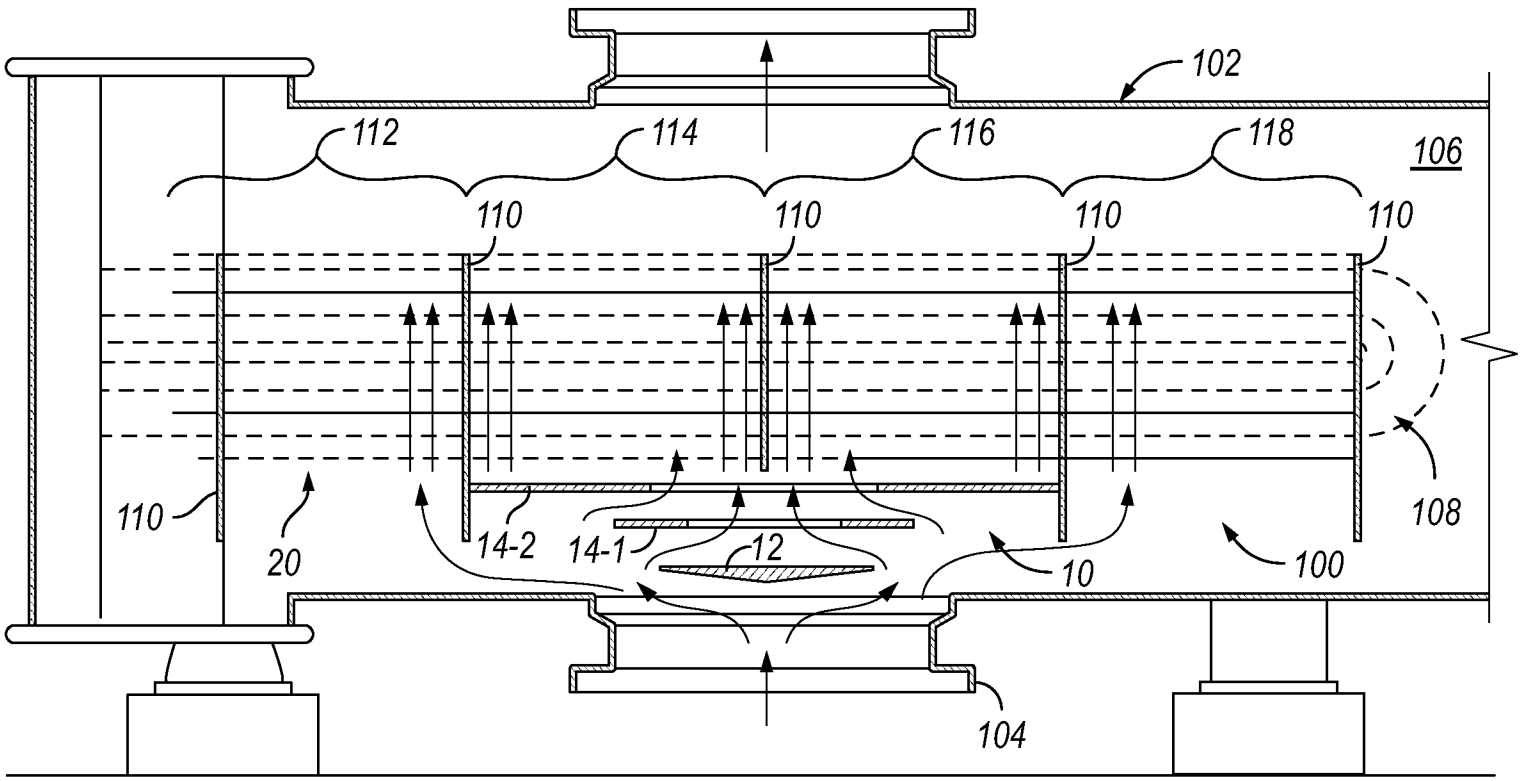
FIG. 3 is a side plan view of an inlet flow distributor positioned in the inlet nozzle of a heat exchanger.

The area of the inlet distributor plate, the area of each window distributor plate, the area of the window in each window distributor plate, and the space between each distributor plate is selected to allow for flow from the inlet nozzle to be redirected around the distributor plates with part of the flow passing through the windows and to the next plate but such that none of the flow hits the tube-bundle directly from the inlet nozzle. The flow around inlet flow distributor 10 can be understood with reference to FIG. 3.

Fluid flows through inlet nozzles 104 and hits inlet distributor plate 12. The fluid flows around inlet distributor plate 12 and strikes the adjacent window distributor plate 14-1 or flows out to the edges of the shell. Focusing on the fluid that strikes the adjacent window distributor plate 14-1, a portion of that fluid flows around the outside edges of window distributor plate 14-1 and strikes the adjacent window distributor plate 14-2. A portion of the fluid that strikes window distributor plate 14-2 flows around the outside edges of window distributor plates 14-2 and is directed toward sections one and four of the tube-bundle. Returning to window distributor plate 14-1 the remaining portion of the fluid flows through the window in window distributor plate 14-1 and through the window in window distributor plate 14-2 and toward sections two and three of the tube-bundle. Of the portion of the fluid that strikes window distributor plate 14-2 from the outside edge of window distributor plate 14-1, the remaining portion flows through the window in window distributor plate 14-2 mixing with the fluid from the window in window distributor plate 14-1 and flows toward sections two and three of the tube-bundle.

The material of construction of each distributor plate in the inlet flow distributor can depend on the fluid flowing in the shell side of the heat exchanger, where one of skill in the art would select a material that would not degrade.

Figure 6A:
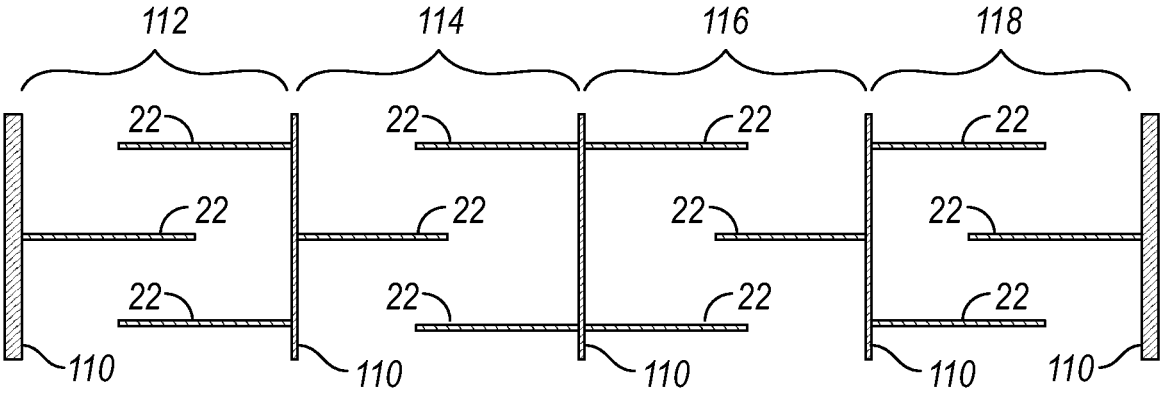
FIG. 6A is a side view of a flow guidance system containing three plates.

Flow guidance system 20 is positioned in tube-bundle 108. Flow guidance system 20 includes a two or more rectangular flow guidance plates arranged to distribute fluid flow over the tube-bundle. Advantageously, the flow guidance plates are rectangular because a rectangular shape provides for more control of the flow and enables directing the flow over and through the tube-bundle. Flow guidance system 20 can include two flow guidance plates 22, three flow guidance plates 22, four flow guidance plates 22, five flow guidance plates 22, or more than five flow guidance plates 22. In at least one embodiment, flow guidance system 20 includes three flow guidance plates 22. The number of flow guidance plates 22 can depend on the size of the tube bundle and the size of the shell of the shell-and-tube heat exchanger. Flow guidance plate 22 can be understood with reference to FIG. 2 and FIGS. 6B and 6C. Each flow guidance plate 22 can be rectangular in shape. In at least one embodiment, a flow guidance plate 22 running parallel to the middle of tube-bundle 108, can extend outside the outer diameter of tube-bundle 108 to be used as sealing device to prevent flow leakages outside the tube bundle. Each flow guidance plate 22 can extend to end vertical support baffles 110, through end vertical support baffles 110, or short of end vertical support baffles 110. Each flow guidance plate 22 contains at least one opening 24 per zone of the tube-bundle. The zones of the tube-bundle are defined by vertical support baffled perpendicular to the tube-bundle and installed for the purpose of anchoring the tube-bundle and supporting it within the shell side of the shell-and-tube-heat exchanger. In FIGS. 2 and 6A, the zones are denoted 112, 114, 116, and 118. In at least one embodiment, each flow guidance plate 22 contains one opening per zone of the tube-bundle. The openings control flow behavior within the tube-bundle. In at least one embodiment, flow guidance plate 22 ends before reaching end vertical support baffles 110 and the space between the end of flow guidance plate 22 and end vertical support baffles 110 are openings for the fluid to flow.

The one or more openings in each flow guidance plate 22 are designed to function with the openings in the other flow guidance plates 22 to direct the fluid across tube-bundle 108. The configuration of openings across flow guidance system 20 can be arranged based on the fluid, operating conditions, size of tube-bundle 108, number and position of vertical support baffles 110, and combinations of the same. The configuration of openings across flow guidance system 20 can be designed to direct flow within each of the zones. The openings can alternate between flow guidance plates when the flow guidance plates are stacked vertically. As a result of the alternated openings the fluid flows across the tube-bundle within each zone. Advantageously, the design of the flow guidance system directs flow across the tube-bundle, enables coverage of more surfaces, and creates turbulent flow with minimal pressure drop. The flow through the zones can create a zig zag pattern across the tube-bundle. One of skill in the art can appreciate that the number of flow guidance plates, the location of each flow guidance plate within the tube-bundle, and the arrangement of openings in each flow guidance plate can depend on the fluid, fluid flow rate, and configuration of the heat exchanger.

Figure 6B:
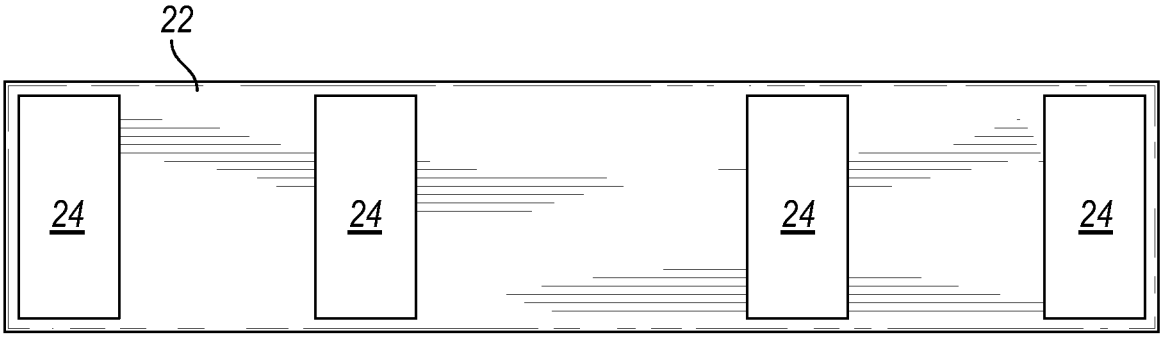
FIG. 6B is a top view of the top and bottom plate of a flow guidance system containing three plates.
Figure 6C:
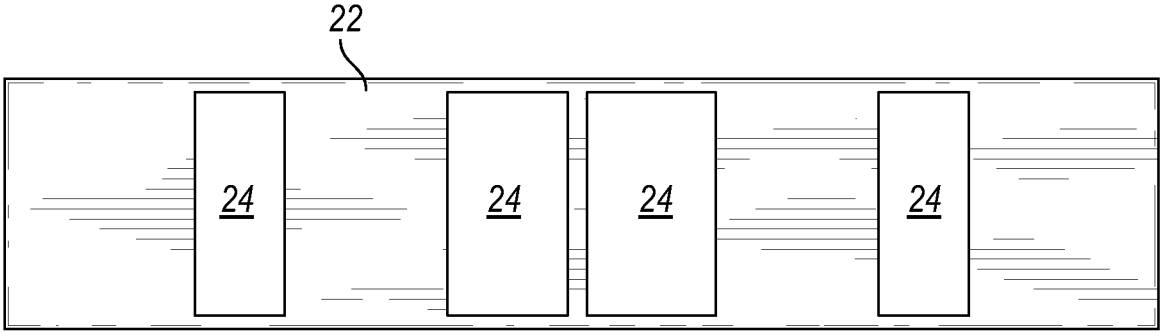
FIG. 6C is the top view of the middle plate of a flow guidance system containing three plates.

FIGS. 6A-6C provide an embodiment of flow guidance system 20 containing three flow guidance plates 22. Each flow guidance plate 22 contains four openings. The first and third flow guidance plates, flow guidance plate 22-1 and flow guidance plate 22-3 are the same with the openings positioned on the left side of zones 112 and 114 and the right sides of zones 116 and 118 as can be seen in FIG. 6A. The second flow guidance plate, flow guidance plate 22-2, positioned between the first and third flow guidance plate has the openings positioned located in the opposite locations, the right side of zones 112 and 114 and the left side of zones 116 and 118. The alternating nature of the openings in the flow guidance plates can be seen in FIGS. 6B-6C. The openings alternate between flow guidance plates.

The openings can be sized to overlap the plate in the adjacent flow guidance plates such that no fluid flows directly through multiple plates. Each opening is between 50% and 90% of the width of the flow guidance plate and half the length of the zone. Advantageously, overlapping the openings with the plates avoids direct flow impingement to the tubes of the tube-bundle and enables the velocity within each zone to be similar. The process side heat transfer coefficient is approximately proportional to the cubic root of the total pressure drop across the bundle. Advantageously, introducing a tortuous path for the fluid across the tube-bundle using the fluid guidance system can maximize the heat transfer coefficient by obtaining the appropriate differential pressure. Advantageously, the flow guidance system directs fluid flow to contact all the tubes in the tube-bundle.

Each flow guidance plate has only one opening per zone of the tube-bundle. Each flow guidance plate is in the absence of perforations or multiple holes per zone of the tube-bundle. The use of one opening enables uniform distribution across the tube-bundle. A perforated plate can increase pressure drop across the tube-bundle which reduces heat transfer coefficient. A perforated plate can create jets of the fluid that can damage the tubes of the tube-bundle and cause vibrations.

In at least one embodiment, the shell-side flow distributor includes only the inlet flow distributor. In at least one embodiment, the shell-side flow distributor includes only the flow guidance system. In at least one embodiment, the shell-side flow distributor includes both the inlet flow distributor and the flow guidance system. One of skill in the art can determine the appropriate combination for the shell-side flow distributor based on the fluid, flow rate, and configuration of the heat exchanger.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described here unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed here as from about one particular value to about another particular value and are inclusive unless otherwise indicated. When such a range is expressed, it is to be understood that another embodiment is from the one particular value to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made here.

As used here and in the appended claims, the words "comprise," "has," and "include" and all grammatical variations thereof are each intended to have an open, non-limiting meaning that does not exclude additional elements or steps.

That which is claimed is:

1. A device for distributing flow through a shell side of a shell-and-tube heat exchanger, the device comprising:

a shell-side flow distributor, the shell-side flow distributor configured to direct flow through all zones of a tube-bundle positioned in the shell, the shell-side flow distributor comprising:

an inlet flow distributor, the inlet flow distributor configured to direct flow from an inlet nozzle to all zones of the tube-bundle, the inlet flow distributor comprising: an inlet distributor plate positioned proximate to the inlet nozzle in the shell side; and one or more window distributor plates, each window distributor plate comprising a window extending through a thickness of the window distributor plate, wherein the one or more window distributor plates are arranged in a vertical stack adjacent to the inlet distributor plate, wherein the size of each window in each window distributor plate is between 25% and 95% of the area of the window distributor plate and the size of the window distributor plate adjacent to the inlet distributor plate is between 25% and 95% of the area of the inlet distributor plate; and a flow guidance system, the flow guidance system disposed in the tube-bundle, wherein the flow guidance system comprises one or more flow guidance plates.

2. The device of claim 1, wherein the shell-and-tube heat exchanger comprises a shell configuration selected from the group consisting of TEMA type G, TEMA type H, TEMA type J, and TEMA type X.

3. The device of claim 1, wherein the inlet distributor plate is selected from the group consisting of a rectangular plate and an oval plate.

4. The device of claim 1, wherein each window distributor plate is a different size, wherein the vertical stack of window distributor plates is arranged in increasing size such that the smallest window distributor plate is adjacent to the inlet distributor plate and the largest window distributor is nearest the tube-bundle.

5. The device of claim 1, further comprising impingement adsorbers, the impingement adsorbers connecting the inlet distributor plate and the first window distributor plate.

6. The device of claim 1, wherein the one or more flow guidance plates comprise at least one opening in each zone of the tube-bundle, wherein each opening extends through a thickness of the flow guidance plate.

7. The device of claim 6, wherein the flow guidance system comprises at least two flow guidance plates layered in the tube-bundle with space between each flow guidance plate and arranged such that the openings in one flow guidance plate are offset from the other flow guidance plate.

8. The device of claim 1, wherein the inlet flow distributor is positioned in the shell side between the inlet nozzle and the tube-bundle.

9. The device of claim 1, wherein each flow guidance plate is rectangular.

* * * * *